US007556081B2

(12) United States Patent
Cech

(10) Patent No.: US 7,556,081 B2
(45) Date of Patent: Jul. 7, 2009

(54) QUICK CONNECTION DEVICE

(75) Inventor: Michael Cech, Cross Plains, WI (US)

(73) Assignee: Springs Window Fashions LLC, Middleton, WI (US)

( * ) Notice: Subject to any disclaimer, the term of this patent is extended or adjusted under 35 U.S.C. 154(b) by 427 days.

(21) Appl. No.: 11/244,721

(22) Filed: Oct. 6, 2005

(65) Prior Publication Data

US 2006/0237149 A1 Oct. 26, 2006

Related U.S. Application Data

(63) Continuation-in-part of application No. 11/114,667, filed on Apr. 26, 2005, now abandoned.

(51) Int. Cl.
*E06B 9/36* (2006.01)

(52) U.S. Cl. ..... 160/176.1 V; 160/177 V; 160/178.1 V

(58) Field of Classification Search ..... 160/168.1 V, 160/173 V, 176.1 V, 177 V, 178.1 V
See application file for complete search history.

(56) References Cited

U.S. PATENT DOCUMENTS

| | | | | |
|---|---|---|---|---|
| 2,173,275 | A | 9/1939 | Houmere | |
| 2,370,794 | A | 3/1945 | Houmere | |
| 3,369,589 | A | 2/1968 | Benkert, Jr. | |
| 3,844,330 | A | 10/1974 | Hyman | |
| 3,851,699 | A | 12/1974 | Shapiro | |
| 3,946,789 | A | 3/1976 | Ronkolz-Tolle | |
| 4,102,381 | A * | 7/1978 | Bratschi | 160/168.1 R |
| 4,350,197 | A * | 9/1982 | Haller | 160/168.1 R |
| 4,550,038 | A | 10/1985 | Becker et al. | |
| 4,582,109 | A | 4/1986 | Fairbanks | |
| D289,622 | S | 5/1987 | Crowle et al. | |
| 4,724,883 | A | 2/1988 | Liebowitz | |
| D296,310 | S | 6/1988 | Crowle | |
| 4,759,397 | A * | 7/1988 | Walther | 160/166.1 |
| 4,793,396 | A | 12/1988 | Anderson et al. | |
| 4,802,262 | A | 2/1989 | Kasai | |
| 4,846,243 | A | 7/1989 | Schneider | |
| 4,858,668 | A | 8/1989 | Toti | |
| 4,866,819 | A | 9/1989 | Kasai | |
| 5,257,811 | A * | 11/1993 | Biba | 160/168.1 V |
| D343,144 | S | 1/1994 | Matoba | |
| 5,297,607 | A | 3/1994 | Beauchamp | |
| D348,236 | S | 6/1994 | James | |
| 5,339,883 | A | 8/1994 | Colson et al. | |
| 5,392,832 | A | 2/1995 | Colson et al. | |
| 5,454,414 | A | 10/1995 | Colson et al. | |
| 5,490,553 | A | 2/1996 | Colson | |
| 5,551,131 | A | 9/1996 | Anscher | |
| 5,603,369 | A | 2/1997 | Colson | |

(Continued)

FOREIGN PATENT DOCUMENTS

DE 3525515 A1 1/1987

*Primary Examiner*—Blair M. Johnson
(74) *Attorney, Agent, or Firm*—Lerner, David, Littenberg, Krumholz & Mentlik, LLP

(57) ABSTRACT

A quick connection device for removably connecting a headrail and a covering portion of a window covering assembly is disclosed. The quick connection device may include a male portion connected to the headrail and a female portion connected to the covering portion. Preferably, operation of the quick connection device by a user should allow of for the easy removal of the covering portion from the headrail.

26 Claims, 11 Drawing Sheets

U.S. PATENT DOCUMENTS

| | | | | |
|---|---|---|---|---|
| 5,638,880 | A | 6/1997 | Colson et al. | |
| 5,638,881 | A | 6/1997 | Ruggles et al. | |
| 5,659,931 | A | 8/1997 | Anscher | |
| 5,713,407 | A | 2/1998 | Judkins | |
| 5,715,883 | A | 2/1998 | Keith | |
| 5,749,404 | A | 5/1998 | Colson | |
| 5,845,690 | A | 12/1998 | Colson et al. | |
| 5,853,039 | A | 12/1998 | Fraser et al. | |
| 5,865,234 | A | 2/1999 | Nakamura et al. | |
| 5,937,927 | A | 8/1999 | Keith | |
| 6,164,363 | A | 12/2000 | Colson et al. | |
| 6,186,213 | B1 | 2/2001 | Senesac | |
| 6,311,755 | B1 | 11/2001 | Ruggles | |
| 6,360,806 | B1 * | 3/2002 | Bowman et al. | 160/168.1 V |
| 6,450,234 | B2 * | 9/2002 | Welfonder | 160/178.1 V |
| 6,510,885 | B1 | 1/2003 | Shih | |
| 6,533,017 | B1 | 3/2003 | Toti | |
| 6,675,858 | B2 | 1/2004 | Marocco | |
| 6,675,859 | B2 | 1/2004 | Nien | |
| 6,688,373 | B2 | 2/2004 | Corey et al. | |
| 6,755,230 | B2 | 6/2004 | Ulatowski et al. | |
| D494,888 | S | 8/2004 | Buscart | |
| 6,786,269 | B2 | 9/2004 | Senesac | |
| 2001/0037864 | A1 | 11/2001 | Colson et al. | |
| 2002/0007923 | A1 | 1/2002 | Colson et al. | |
| 2002/0079063 | A1 | 6/2002 | Sheward | |
| 2003/0024654 | A1 | 2/2003 | Sheward | |
| 2003/0051823 | A1 | 3/2003 | Nien | |
| 2003/0178153 | A1 | 9/2003 | Senesac | |
| 2004/0149396 | A1 | 8/2004 | Colson et al. | |
| 2004/0149400 | A1 | 8/2004 | Nakamura et al. | |
| 2005/0211392 | A1 | 9/2005 | Elembaby | |

* cited by examiner

QUICK CONNECTION DEVICE

CROSS REFERENCE TO RELATED APPLICATIONS

This application is a continuation-in-part of U.S. application Ser. No. 11/114,667 ("the '667 application"), filed on Apr. 26, 2005, the disclosure of which is incorporated herein by reference.

BACKGROUND OF THE INVENTION

The present invention relates to window covering assemblies, and more particularly to a quick connection device for use in selectively securing a window covering portion to a headrail portion of a window covering assembly.

There are many different types of window coverings and treatments for use in covering windows of all shapes, sizes, and locations. Typically, window covering assemblies include an actual window covering portion, and a headrail preferably operable to allow manipulation of the window covering portion. For example, window coverings generally allow for the selective covering and uncovering of a window, as well as intermediate positions therebetween. Such window covering assembly constructions have been well-known and widely utilized for many years.

Of course, there exist many different variations of these types of window covering assemblies, including those designed specifically for use in certain environments, or in conjunction with certain decors. However, the versatility of such window covering assemblies is often limited to the particular environment for which it was specifically designed. For example, a purchaser of a window covering typically selects a permanent window covering portion color and/or design, and a particular headrail design. Although removal of a window covering portion from a headrail has been allowed by previous designs, it has typically been rather difficult to separate the two portions, and has thusly deterred users of the assemblies from doing so. Heretofore, there simply has not been a window covering that allows for the easy separation of window covering portions with respect to headrails. Clearly, a design which allows easy separation of the window covering portion from the headrail of a window covering assembly may provide several benefits, including but not limited to the easy cleaning and interchangeability of various window covering portions with different headrails, as well as the easy initial installation and removal of the assembly.

Therefore, there exists a need for a window covering assembly that employs a quick connection device which allows for the easy removal of window covering portions from headrails.

SUMMARY OF THE INVENTION

A first aspect of the present invention is a quick connection device for removably connecting a headrail and a window covering portion of a window covering assembly. In certain preferred embodiments in accordance with the present invention, the quick connection device preferably includes a male portion having a first end capable of cooperating with the headrail and a second end including at least one leg. Additionally, the quick connection device preferably includes a female portion having a body capable of engaging the window covering portion, a cavity for receiving the at least one leg of the male portion, and an actuation mechanism for disengaging the male portion from the female portion.

In other embodiments, the quick connection device of the first aspect may include a male portion having a first end that includes a gear for cooperating with at least one gear located in the headrail. Additionally, the at least one leg may include an offset for engaging said female portion. In a preferred embodiment, the male portion preferably includes two legs, each leg including an offset for engaging the female portion. A flexible finger may be disposed between the two legs. The cavity of the female portion may further include a deflectable plate for engaging the two offsets. Preferably, the actuation mechanism is a button, the depression of which causes deflection of the deflectable plate and disengagement of the offsets from said deflectable plate. The male portion may further include a key and the female portion may further include a keyway for receiving the key. Finally, the body capable of engaging the window covering portion is a hem bar body that is a substantially flat elongate body capable of being received in a fabric covering portion.

A second aspect of the present invention is a window covering assembly. In accordance with various embodiments of this aspect, the window covering assembly may include a headrail, a window covering portion and at least one quick connection device forming a removable connection between the headrail and the window covering portion. In connection with other embodiments of this second aspect the headrail is preferably capable of manipulating the window covering portion between an open position, a closed position and a light filtering position. It is contemplated to provide a window covering portion constructed of a fabric material or a plurality of vanes.

Yet another aspect of the present invention is a method of providing window blind assemblies. Preferably, this method includes the steps of providing a plurality of different headrails, each headrail including at least one first portion of a quick connection device and providing a plurality of different window covering portions, each covering portion including at least one second portion of the quick connection device. Preferably, the first portion is capable of engaging the second portion to form a removable connection therebetween.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION

Figure 1:
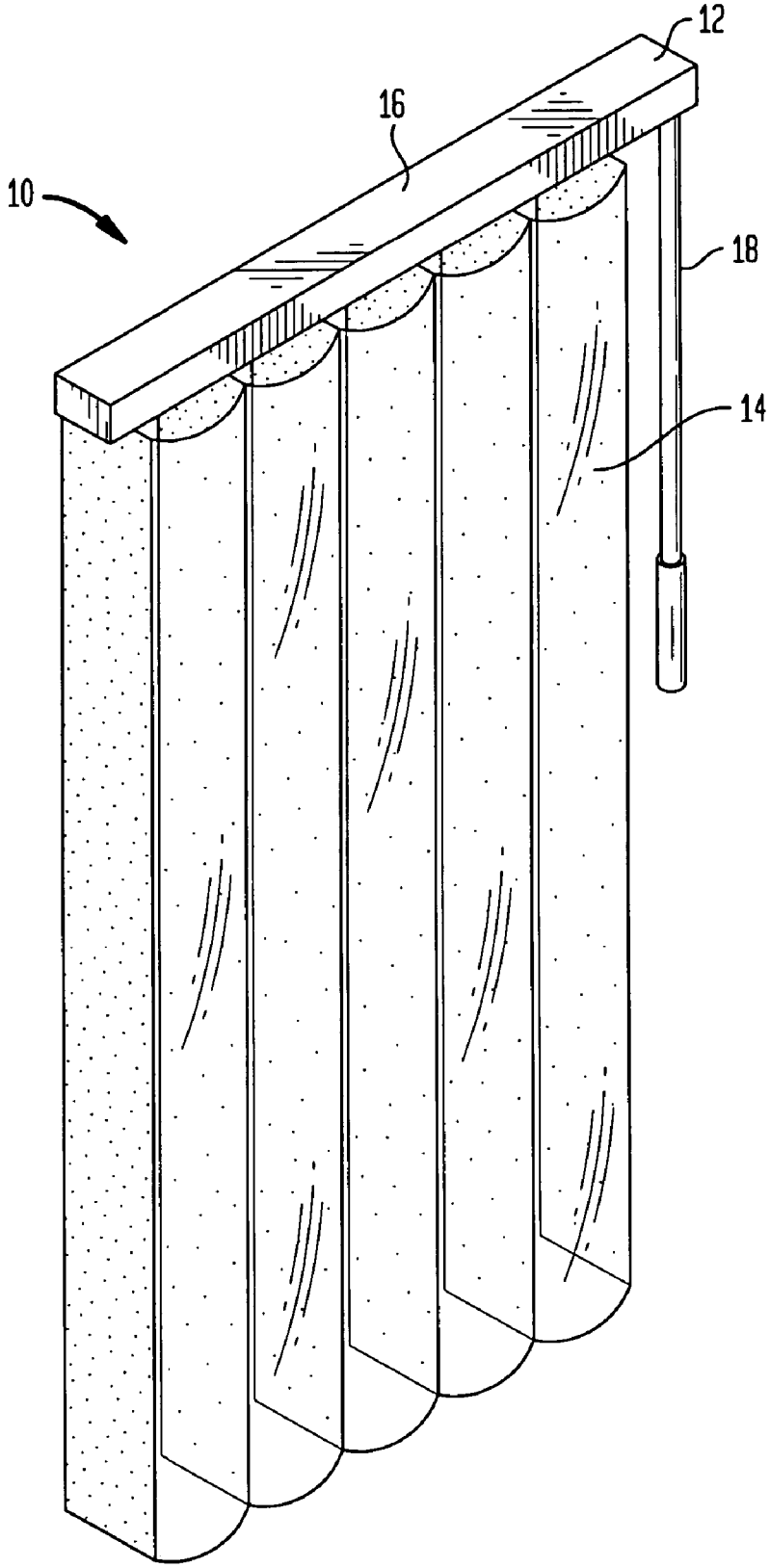
FIG. 1 is a perspective view of a window covering assembly employing a quick connection device in accordance with the present invention.

Referring to the drawings, wherein like reference numerals refer to like elements, there is shown in FIG. 1, a window covering assembly or shade designated generally by reference numeral 10. This window covering assembly is disclosed in commonly assigned U.S. patent application Ser. No. 11/114,667 ("the '667 application") filed on Apr. 26, 2005, the disclosure of which is has been incorporated herein by reference above, and of which the present application is a continuation-in-part. However, it is noted that this window covering assembly is only one example of such an assembly for use in accordance with the present invention. For example, the quick connection device described in the present application may be utilized in conjunction with many types of window coverings, including but not limited to Venetian blinds, Roman Shades, curtains, and the like, as well as both vertical and horizontal iterations of same. It would be apparent to one of ordinary skill in the art to modify any of those types of window covering assemblies in order to utilize the quick connection device disclosed herein. This will be more fully disclosed below.

As best shown in FIG. 1, window covering assembly 10 is a vertical shade and preferably includes a headrail portion 12 and a window covering portion 14. It is noted that the various functions of window covering assembly 10 are such that they provide the ability to move between a closed position where the covering substantially covers a window, an open or traversed position where the covering substantially uncovers a window, and intermediate positions where the window covering at least partially blocks visibility through a window while allowing light to enter therethrough. This latter position will be referred to throughout as a light filtering position and is achieved through the rotation of certain elements of covering 10. Essentially, the light filtering position prevents clear view through window covering assembly 10, but does allow for a large amount of light to beam through. Thus, the benefit of a sunny day may be enjoyed while still maintaining a substantial level of privacy. It is also noted that covering 10 may also be situated such that covering portion 14 extends across different amounts of a window.

In accordance with the present invention, headrail portion 12 may be any headrail known in the art that is capable of providing for both traversing and rotational motion to portions of covering portion 14. Prior art headrails are well known for achieving such operation. For example, suitable headrails are disclosed in U.S. Pat. Nos. 4,214,622, 4,316,493, 5,894,877, 6,755,230 and 6,786,289, the disclosures of which are hereby incorporated by reference herein. Nevertheless, a simplified preferred headrail 12 preferably includes a housing 16 for supporting and accommodating the various components of the headrail and a wand 18 rotatably connected to the other headrail components. Preferably, traversing and/or rotational motion of wand 18 should provide like traversing and/or rotational motion to portions of window covering portion 14. Essentially, traversing motion allows for the selective covering and uncovering of a window, while rotational motion allows for the varying of the amount of light through portion 14. In the window covering embodiment disclosed in the '667 application and shown in FIG. 1 of the present application, covering portion 14 is preferably made of a fabric material having both opaque and sheer portions. However, as mentioned above, other window covering assemblies are clearly envisioned for use in conjunction with the present invention.

Figure 2A:
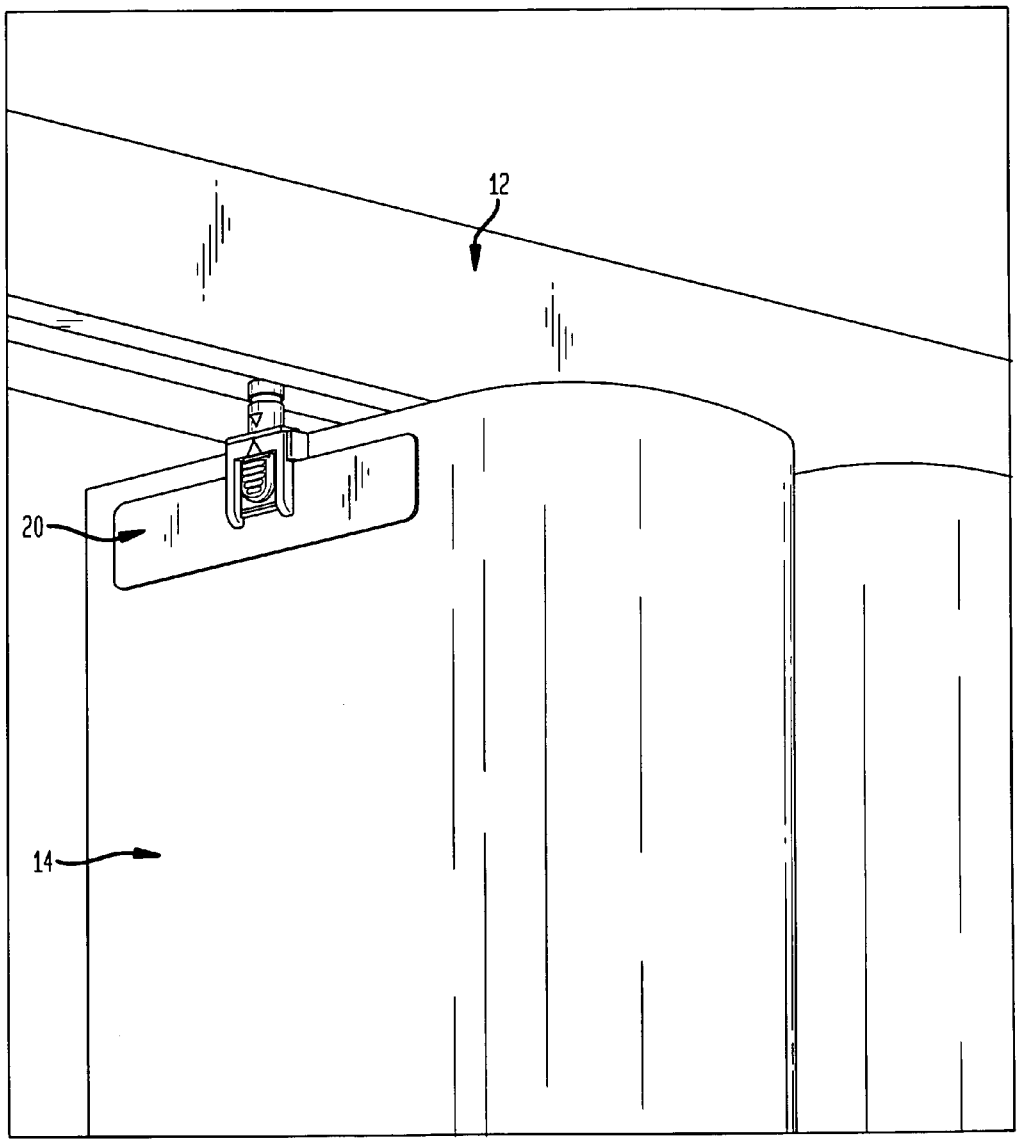
FIG. 2A is an enlarged perspective view of the window covering assembly of FIG. 1, focusing on the quick connection device.
Figure 2B:
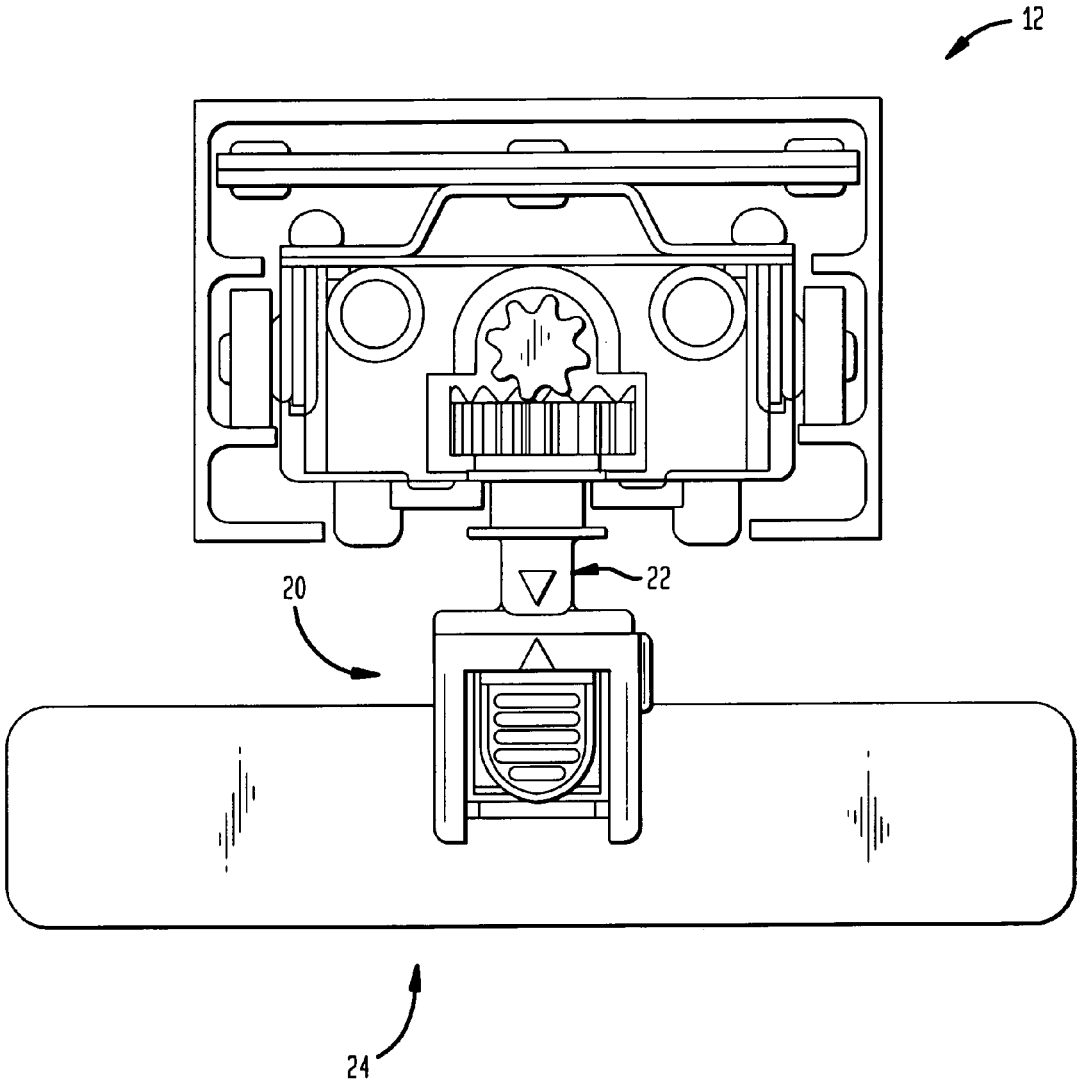
FIG. 2B is an enlarged cross sectional view depicting the cooperation of the quick connection device and certain components of the window covering assembly of FIG. 1.

As best shown in FIGS. 2A and 2B, a quick connection device 20 is provided in accordance with the present invention to connect window covering portion 14 to headrail 12. Quick connection 20 preferably includes a male portion 22 that is connected to headrail 12, and a female portion 24 that is connected to covering portion 14. In the preferred embodiment shown in the figures, male portion 22 and female portion 24 are designed so as to detachably cooperate with one another through their particular complimentary designs, as will be more fully described below. However, it is noted that while one specific embodiment quick connection device 20 is depicted in the figures, other configurations are envisioned. In particular, it is noted that other mechanical structures may be utilized, and the quick connection may be modified so as to be utilized in conjunction with different types of window covering assemblies. In other words, many different quick connection structures may be utilized in accordance with the present invention.

Figure 3:
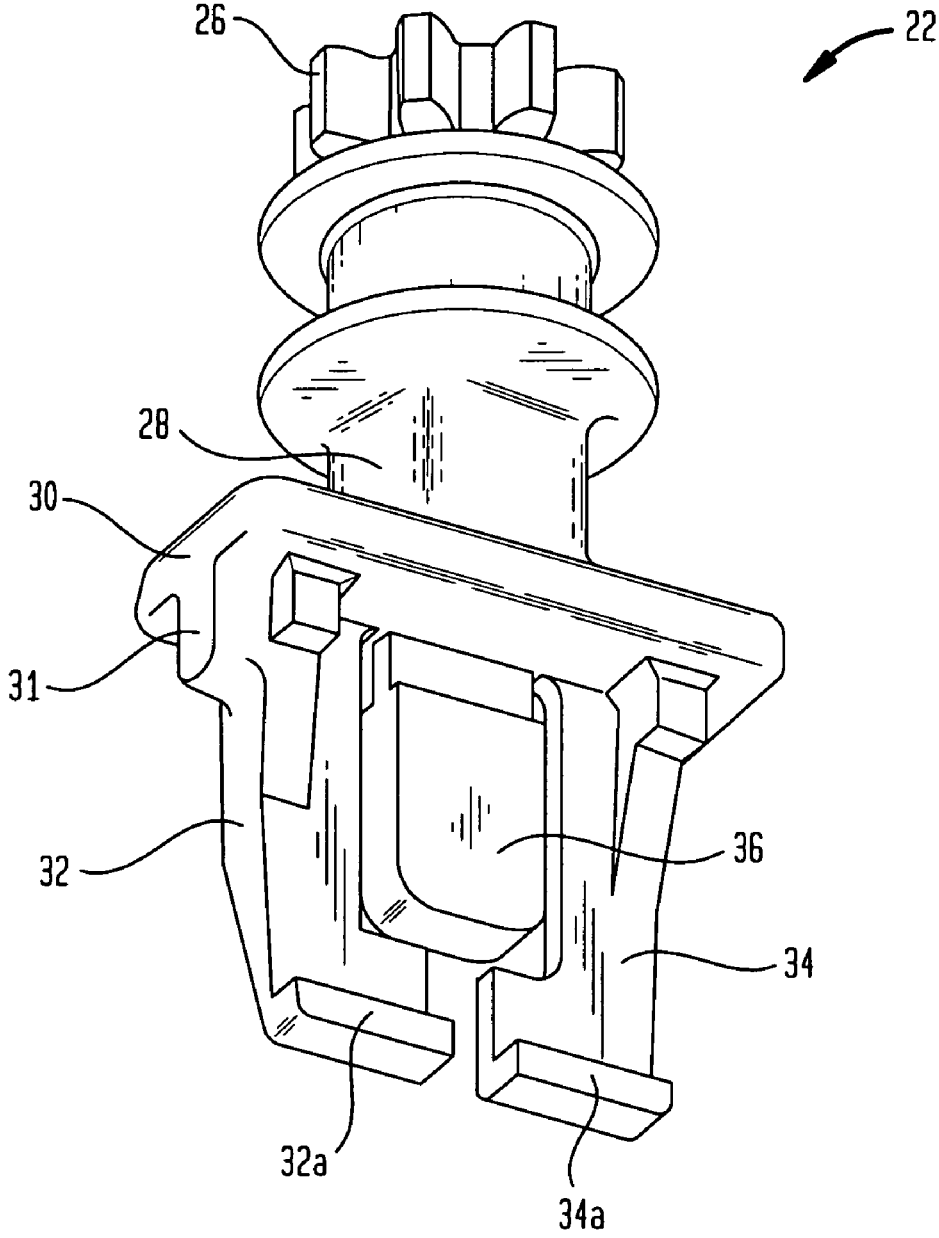
FIG. 3 is a perspective view of a male portion of the quick connection device depicted in FIG. 1.
Figure 4:
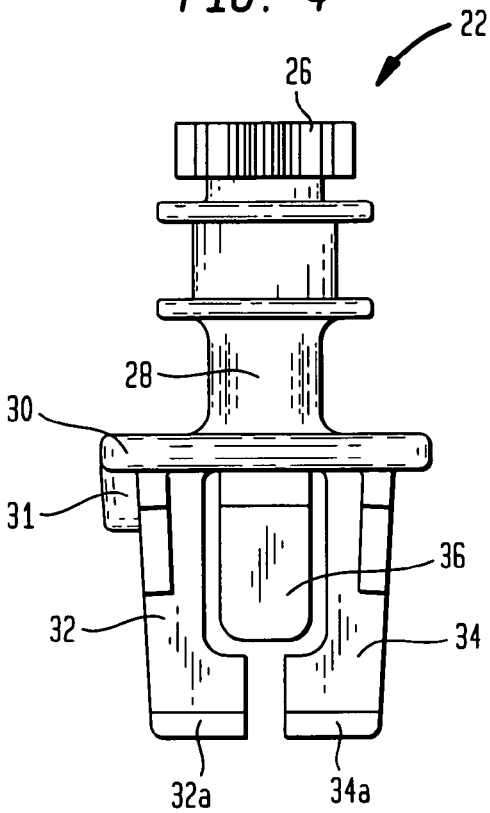
FIG. 4 is front plan view of the male portion depicted in FIG. 3.
Figure 5:
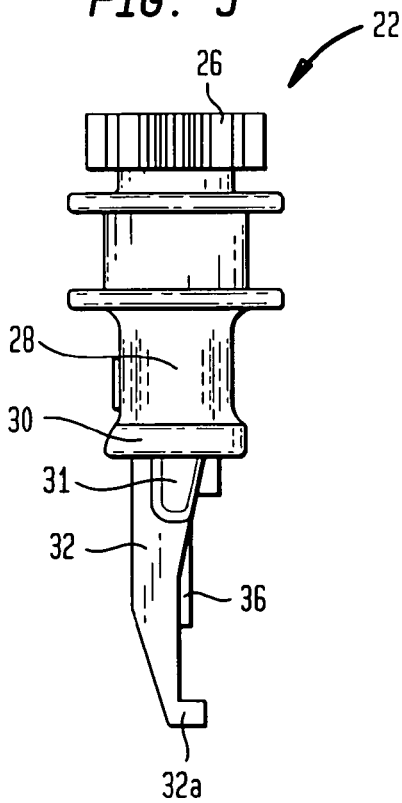
FIG. 5 is a side plan view of the male portion depicted in FIG. 3.
Figure 6:
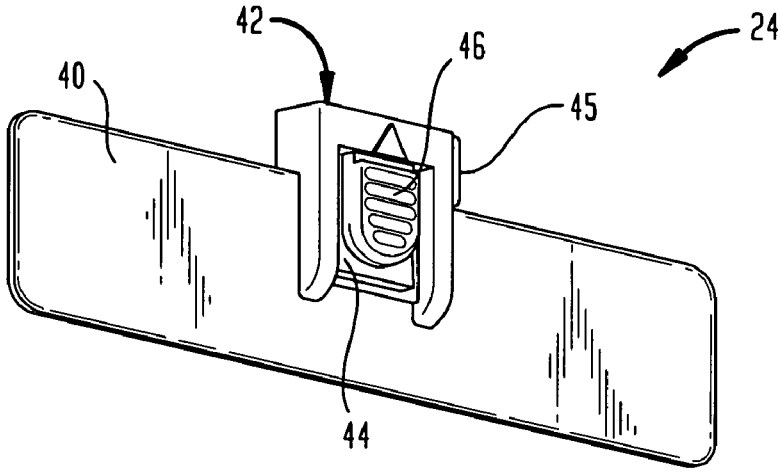
FIG. 6 is a perspective view of a female portion of the quick connection device depicted in FIG. 1.
Figure 7:
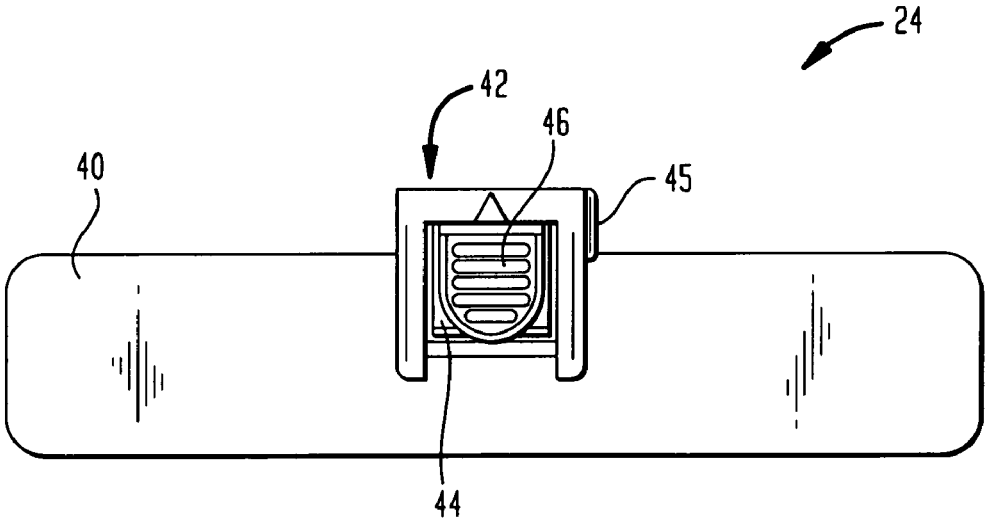
FIG. 7 is a front plan view of the female portion depicted in FIG. 6.
Figure 8:
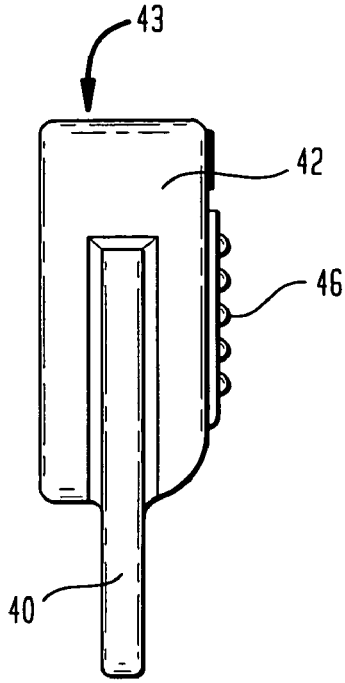
FIG. 8 is a side plan view of the female portion depicted in FIG. 6.
Figure 9:
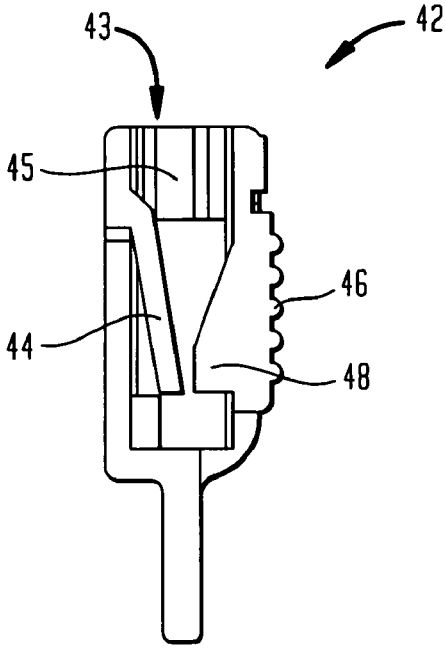
FIG. 9 is an enlarged side cross sectional view of a portion of the female portion depicted in FIG. 6.

In the preferred embodiment shown in the figures, male portion 22 is adapted to cooperate with headrail 12 and also to interconnect with female portion 24. As best shown in FIGS. 3-5, male portion 22 includes a gear portion 26, a stem 28, a base 30, a key 31, legs 32 and 34, and a flexible finger 36. In addition, leg 32 further includes an offset 32*a* and leg 34 further includes an offset 34*a*. Gear portion 26 is preferably adapted to interconnect with certain of the components (not shown) situated in headrail 12. More particularly, gear portion 26 is configured in the fashion of a typical gear, so that it mates with other gears (best shown in FIG. 2B) located in headrail 12. In a preferred embodiment, rotation of wand 18 causes these certain gears (FIG. 2B) to also rotate, thereby rotating male portion 22 and ultimately window covering portion 14. Stem 28 provides a relatively elongated connection between gear portion 26 and base 30. This provides length between the connection with headrail 12 and base 30. Key 31 is essentially a protrusion extending outwardly from male portion 22 to mate with a keyway (discussed below) to ensure quick connection device 20 is assembled correctly. Legs 32 and 34 extend from base 30, and are adapted to be received within female portion 24. This engagement, as well as the cooperation of offsets 32*a* and 34*a* with female portion 24, will be more fully discussed below. Finally, male portion 22 includes flexible finger 36. Essentially, finger 36 is a flexible member which extends from base 30, between legs 32 and 34. Once again, its purpose and cooperation with the other elements of quick connection 20 will be discussed further below.

In the preferred embodiment shown in the figures, female portion 24 is adapted to cooperate with covering portion 14 and also to interconnect with male portion 22. As best shown in FIGS. 6-9, female portion 24 further includes a hem bar body 40, an opening body 42, a deflectable plate 44, a keyway 45 and a depressible button 46. Preferably, hem bar body 40 is an elongate rectangular shape, which is adapted to be received within a pocket formed on certain sections of covering portion 14. As best shown in FIG. 2, hem bar body 40 is preferably received within pockets located on individual panels of covering portion 14. This cooperation may be such that hem bar body 40 is permanently or removably received within these pockets. It is noted that in embodiments which utilize differing window covering assemblies, hem bar body 40 may be adapted to be received, to connect to different types of covering portions 14, or even formed integrally therewith. Opening body 42 is preferably formed integrally with and located centrally within the confines of hem bar body 40. Essentially, opening body 42 is a receptacle for receiving elements of male portion 22 therein. Body 42 preferably defines a cavity which can be accessed by opening 43 (best shown in FIGS. 9 and 10). As will be more fully discussed below, legs 32 and 34 of male portion 22 are adapted to fit through opening 43 and into this cavity. Deflectable plate 44 is also located within opening body 42 and is preferably flexible in nature. Its operation will be discussed further below. Keyway 45 is adapted for mating with key 31 of male portion 22. This cooperation ensures the proper assembly of male portion 22 and female portion 24. Essentially, key 31 and keyway 45 will only allow male portion 22 and female portion 24 to be assembly in one direction. Finally, female portion 24 includes depressible button 46 having a projection 48 (best shown in FIG. 9). Button 46 is preferably flexible in nature, so that after depression of it, the button will return to its original position. This button is preferably operable by a user to cause male and female portions 22 and 24 to become disconnected from one another, thereby causing headrail 12 and covering portion 14 to become disconnected. Once again, this will be more fully discussed below in the discussion regarding the operation of the various elements of quick connection device 20. However, it is noted that many different actuation mechanisms may be utilized to provide similar function to that of button 46.

Figure 10:
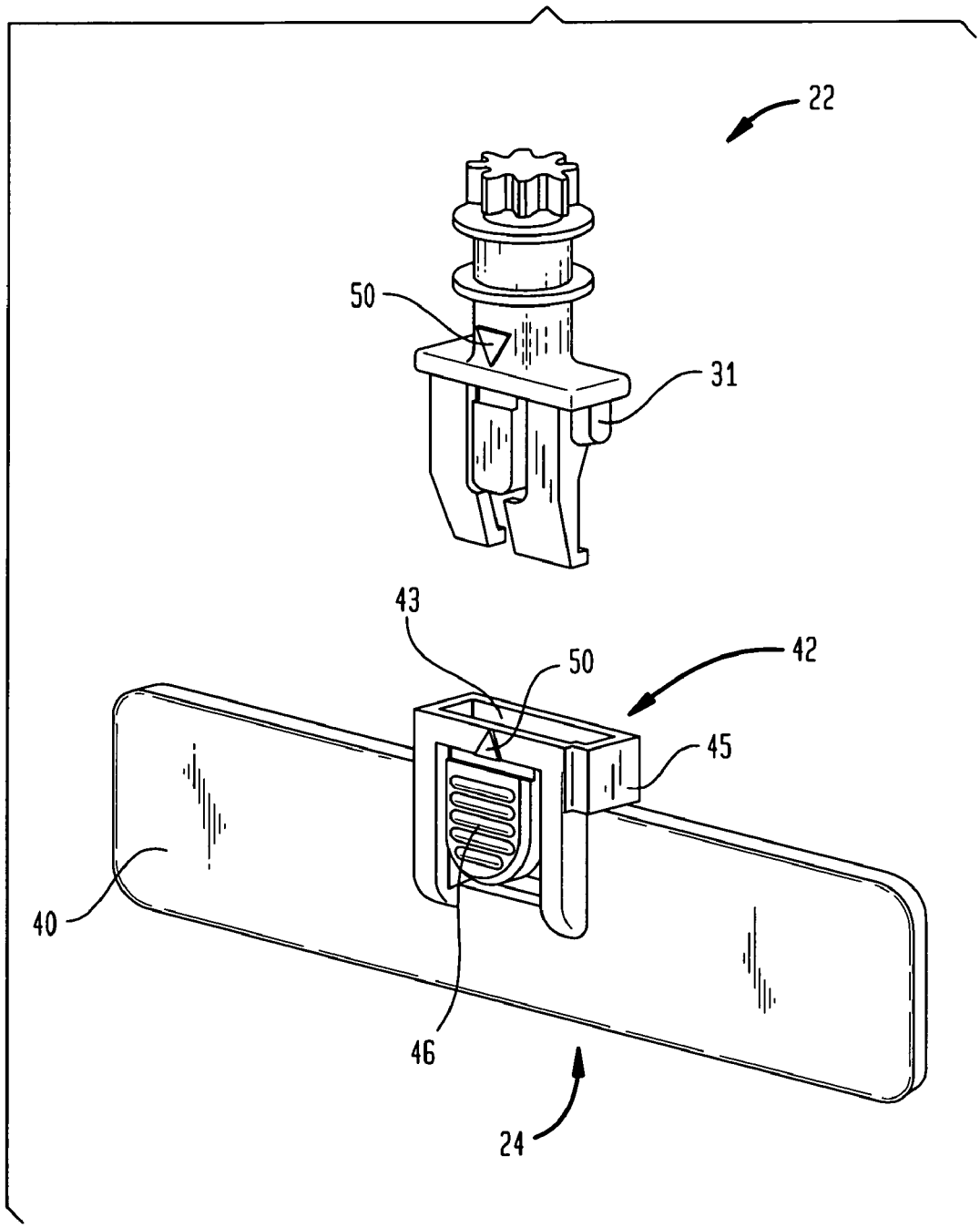
FIG. 10 is a perspective view of the quick connection device employing the portions depicted in FIGS. 3 and 6, in an unassembled state.
Figure 11:
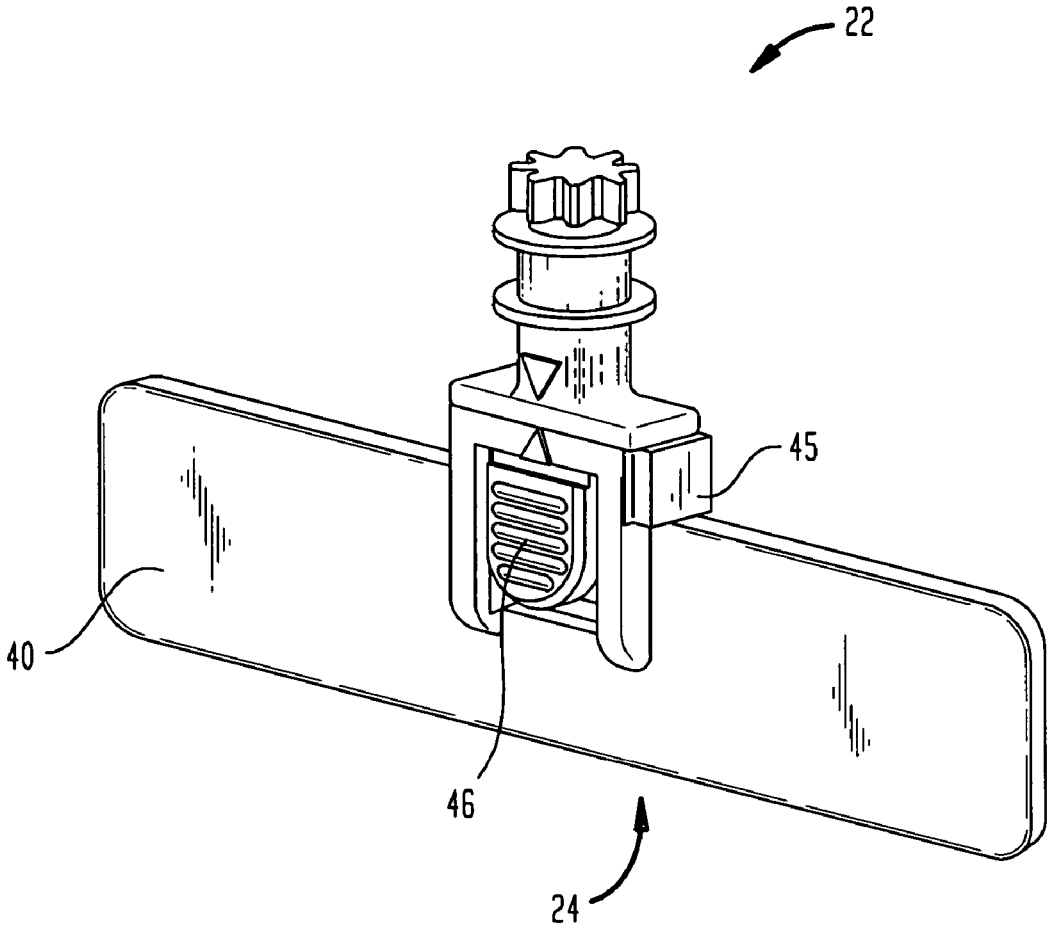
FIG. 11 is a perspective view of the quick connection device employing the portions depicted in FIGS. 3 and 6, in an assembled state.
Figure 12:
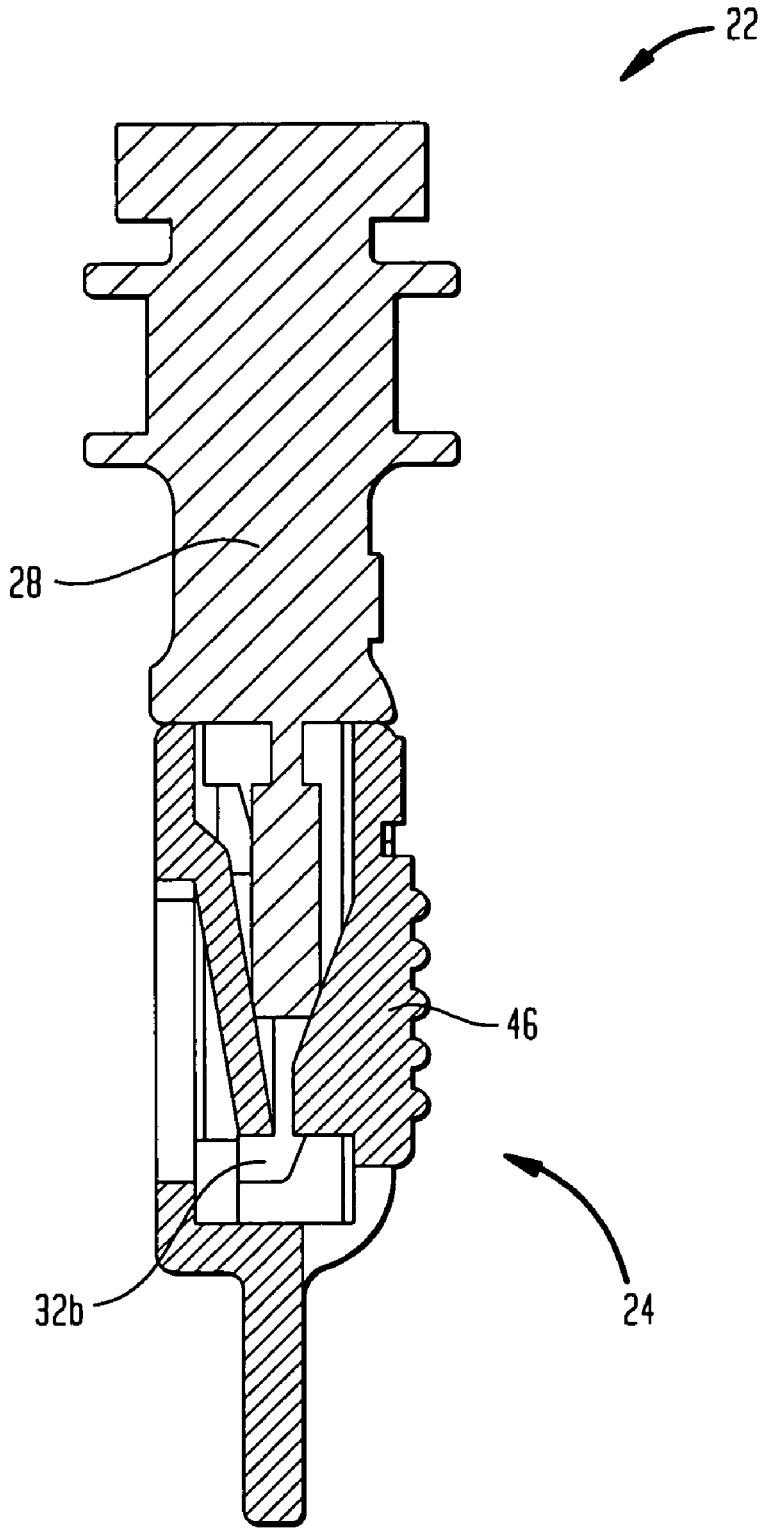
FIG. 12 is an enlarged side cross sectional view of the portions assembling the quick connection device depicted in FIG. 11.

FIGS. 10 and 11 depict the different components of quick connection device 20 in differing states of connection. Namely, FIG. 10 shows male portion 22 disconnected from female portion 24, and FIG. 11 shows male portion 22 connected to female portion 24. It is noted that while male and female portions 22 and 24 are shown by themselves in these figures, it is to be understood that in a typical use, male portion 22 would be connected to headrail 12 or the like, and female portion 24 would be connected to covering portion 14 or the like. They are shown without these elements of window covering 10 for clarity purposes. As shown in FIG. 10, in a connection process, male portion 22 and female portion 24 are initially aligned so that legs 32 and 34 align with opening 43, and key 31 aligns with keyway 45. Thereafter, legs 32 and 34 are inserted through opening 43 so that they are retained within opening body 42, and key 31 is inserted into keyway 45. More particularly, upon insertion of legs 32 and 34 into opening body 42, offsets 32*a* and 34*a* deflect deflectable plate 44 until the offsets pass by the plate, at which time plate 44 deflects back into its original position, thereby capturing offsets 32*a* and 34*a* within body 42. This engaged cooperation between male portion 22 and female portion 24 is best shown in FIGS. 11 and 12. It is noted that absent operation of any of the other elements of quick connection device 20, the two portions will remain in this connected position. Clearly, this is beneficial for providing a simple connection between headrail 12 and covering portion 14. It is noted that male portion 22 and female portion 24 may also include indicia, such as arrows 50, which aid a user in determining the correct orientation of the two components of device 20. These arrows are best shown in FIGS. 10 and 11.

In order to separate the male and female portions 22 and 24, operation of button 46 is required. Depression of this button causes projection 48 (best shown in FIGS. 9 and 11) to engage both flexible finger 36 of male portion 22 and deflectable plate 44 of female portion 24. The sloped nature of projection 48 allows for this dual contact, with the more extended portion of the projection actually extending through the slot formed between legs 32 and 34 in order to contact deflectable plate 44. Upon a significant amount of force being applied by projection 48, finger 36 is deflected so as to deflect plate 44 in turn. In addition, at least a small amount of force is directly applied from projection 48 to plate 44 to deflect same. Once enough deflection of plate 44 is achieved, offsets 32*a* and 32*b* become dislodged from deflectable plate 44, and the sloped nature of projection 48 causes male portion 22 to be thrust away from female portion 24. Thus, depression of button 46 causes an almost spring-like disconnection between male and female portions 22 and 24. This may be useful to a user in that he or she may simply depress different buttons 46 of different quick connection devices 20, without having to pull apart male and female portions 22 and 24, in order to ultimately remove covering portion 14 from headrail 12.

In a preferred embodiment, quick connection device 20 is constructed of a polymeric material suitable for allowing a strong and rigid connection, while also allowing for certain of the elements of the device to be flexible. For example, in a preferred embodiment, male portion 22 of quick connection device 20 is constructed of nylon and female portion 24 of quick connection device 20 is constructed of acetal. However, it is envisioned to utilize different materials to construct quick connection device 20. For example, it may be possible to utilize metals which allow for substantially similar operation and flexibility. In addition, it is noted that all of the elements of quick connection device 20 may be constructed of the same material, and certain of the elements of certain preferred embodiment quick connection devices 20 may be constructed of one material, while other elements are constructed of a different material. For example, it may be desired to provide a quick connection device 20 which includes a metallic gear portion 26 for engaging other metallic gears, while the remainder of the device is polymeric. Clearly, any of the elements may be constructed of a different type of material, as long as the device operates in a suitable manner.

It is noted that quick connection device 20 may allow for many different headrail 12 and covering portions 14 combinations to be utilized. For example, depending upon the particular time of year, differently colored or patterned covering portions 14 may be utilized (e.g.—red or green during the Christmas Holiday season). In addition, in accordance with the present invention, a user may now change covering portions 14 when they change their decor, without having to remove headrail 12 from their window opening. Finally, cleaning of covering portions 14 may be simplified, through the use of quick connection device 20. For example, fabric covering portions 14 may be removed from headrail 12 and machine washed, while plastic or otherwise rigid covering portions (as in Venetian blinds or the like) may be washed in a sink or even hosed down outside.

Manufacturers may also utilize quick connection device 20 to their benefit. For example, manufacturers may now offer mix and match headrail (with or without male portions 22 attached thereto) and covering portion (with or without female portions 24 attached thereto) products. Thus, a consumer would select from different of these components to achieve their desired window covering assembly. This would reduce the overall amount of single combination assemblies the manufacturers would need produce, and hence reduce costs. Finally, it is noted that users may utilize originally purchased quick connection devices 20 in conjunction with new covering portions 14. In order to do so, a consumer would simply remove female portions 24 from an older covering portion 14 and re-insert them into a new covering portion 14. Once again, this provides the benefit of allowing a user to utilize an already mounted headrail in conjunction with a new and different covering portion 14.

Once again, it is to be understood that while one particular embodiment quick connection device 20 is discussed herein, other configurations are envisioned. In other words, the present invention is not limited to the particular quick connection device 20 construction depicted in the figures or discussed in the specification. Rather, those of ordinary skill in the art would clearly recognize that the present invention may be modified or otherwise changed in order to provide differing quick connection devices 20, which are captured by the present invention. Other quick connection devices are envisioned which include additional or less elements, while still encompassing the basic principals of the present invention. For example, it is contemplated to provide a female portion 24 which is configured to cooperate with headrail 12 and a male portion 22 which is configured to cooperate with covering portion 14, among other variations.

Figure 13:
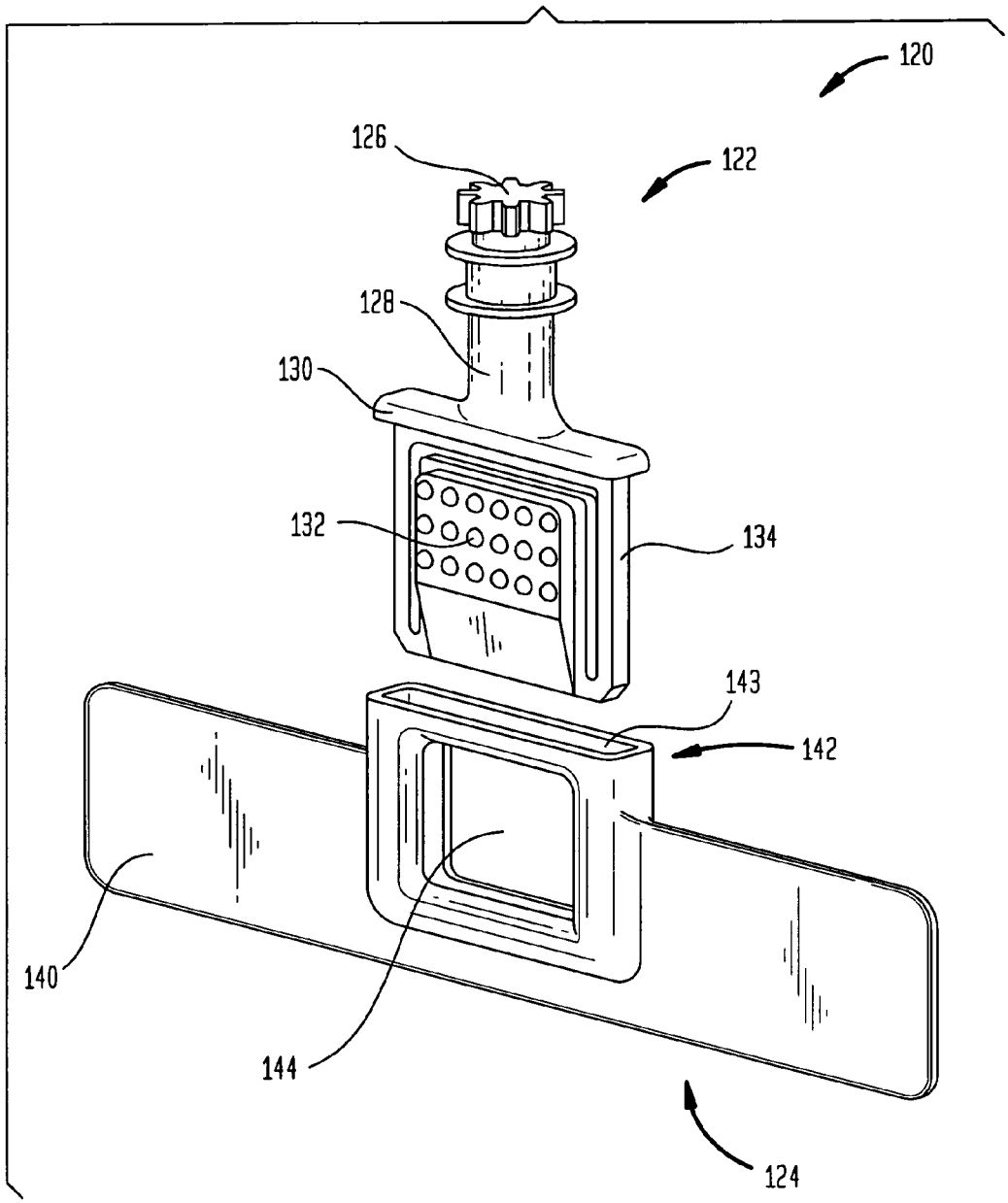
FIG. 13 is a perspective view of a quick connection device according to another embodiment of the present invention, in an unassembled state.

FIG. 13 depicts one such additional variation of a quick connection device in accordance with the present invention. More particularly, FIG. 13 depicts a second embodiment quick connection device generally designated by reference numeral 120. As with above discussed quick connection device 20, device 120 includes male and female portions 122 and 124. Male portion 122 further includes a gear portion 126, a stem 128, a base 130, which are all similar to like elements in male portion 22 discussed above. However, in this embodiment, male portion 122 includes a depressible button 132 and a single body 134, rather than two legs. In addition, female portion 124 includes a hem bar body 140, an opening body 142, and an opening 143, similar to like elements in female portion 24 discussed above. However, once again, female portion includes a different element, namely through hole 144. In operation, depressible button 132 and single body 134 are adapted to be placed into opening 143 of opening body 142. As button 132 may have resilient properties, it preferably springs into through hole 144 upon full insertion of button 132 and body 134 into opening body 142. This creates a connection between male and female portions 122 and 124 that remains in place absent an intervening force. In fact, male and female portions 122 and 124 remain connected together until button 132 is depressed while portions 122 and 124 are simultaneously pulled apart. Thus, similar to the above device 20, quick connection device 120 provides another means for removably connecting a window covering portion 14 to a headrail 12 or the like. Nonetheless, it is to be understood that this is merely an additional embodiment of many that may be provided in accordance with the present invention.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A window covering assembly comprising:

a headrail;

a window covering portion; and at least one quick connection device forming a removable connection between said headrail and said window covering portion, said quick connection device including a male portion having a first end and a second end, said second end including a first leg having a first offset, a second leg having a second offset, and a flexible finger disposed between said first and second legs; and a female portion having a cavity for receiving said second end of said male portion, said first and second offsets engaging said female portion, wherein one of said male or female portion further includes a button for disengaging said male portion from said female portion.

2. The window covering assembly of claim 1, wherein said headrail is capable of manipulating said window covering portion between an open position, a closed position and a light filtering position.

3. The window covering assembly of claim 1, wherein said window covering portion is constructed of a fabric material.

4. The window covering assembly of claim 1, wherein said window covering portion is constructed of a plurality of vanes.

5. The window covering assembly of claim 1, wherein (1) said first end of said male portion is capable of cooperating with said headrail and (2) said female portion further includes a hem bar body capable of engaging said window covering portion and said cavity receives said first leg of said male portion.

6. The window covering assembly of claim 5, wherein said first end of said male portion includes a gear for cooperating with at least one gear located in said headrail.

7. The window covering assembly of claim 6, wherein said female portion further includes a deflectable plate for engaging said first and second offsets.

8. The window covering assembly of claim 7, wherein said female portion includes said button, the depression of which causes deflection of said deflectable plate and disengagement of said first and second offsets from said deflectable plate.

9. The window covering assembly of claim 8, wherein said hem bar body is a substantially flat elongate body capable of being received in a fabric covering portion.

10. The window covering assembly of claim 9, wherein said male portion further includes a key and said female portion further includes a keyway for receiving the key.

11. The window covering assembly of claim 1, wherein said male portion includes said button.

12. A window covering assembly comprising:

a headrail;

a window covering portion; and a quick connection device removably connected to said headrail and said window covering portion, said quick connection device including:

a male portion having a first end cooperatively engaged with said headrail and a second end having a first leg with a first offset; and a female portion having a body cooperatively engaged with said window covering portion, a cavity for receiving said first leg of said male portion, a deflectable plate for engaging said first offset, and a button for disengaging said male portion from said female portion, wherein depression of said button causes deflection of said delectable plate and disengagement of said first offset from said deflectable plate.

13. The window covering assembly of claim 12, wherein said headrail is capable of manipulating said window covering portion between an open position, a closed position and a light filtering position.

14. The window covering assembly of claim 12, wherein said window covering portion is constructed of a fabric material.

15. The window covering assembly of claim 12, wherein said window covering portion is constructed of a plurality of vanes.

16. The window covering assembly of claim 12, wherein said female portion further includes a hem bar body capable of engaging said window covering portion.

17. The window covering assembly of claim 16, wherein said hem bar body is a substantially flat elongate body capable of being received in a fabric covering portion.

18. The window covering assembly of claim 12, wherein said first end of said male portion includes a gear for cooperating with at least one gear located in said headrail.

19. The window covering assembly of claim 12, wherein said male portion further includes a second leg including a second offset for engaging said female portion, and a flexible finger disposed between said first and second legs.

20. The window covering assembly of claim 12, wherein said male portion further includes a key and said female portion further includes a keyway for receiving the key.

21. A window covering assembly comprising:

a headrail;

a window covering portion; and at least one quick connection device forming a removable connection between said headrail and said window covering portion, said quick connection device including:

a male portion having a first end including a gear for cooperating with at least one gear located in said headrail and a second end including a first leg having a first offset, a second leg having a second offset, and a flexible finger disposed between said first and second legs; and a female portion having a hem bar body capable of engaging said window covering portion, a cavity for receiving said first leg of said mail portion, a deflectable plate for engaging said first and second offsets, and a button for disengaging said male portion from said female portion, wherein depression of said button causes deflection of said deflectable plate and disengagement of said first and second offsets from said deflectable plate.

22. The window covering assembly of claim 21, wherein said hem bar body is a substantially flat elongate body capable of being received in a fabric covering portion.

23. The window covering assembly of claim 22, wherein said male portion further includes a key and said female portion further includes a keyway for receiving the key.

24. The window covering assembly of claim 21, wherein said headrail is capable of manipulating said window covering portion between an open position, a closed position and a light filtering position.

25. The window covering assembly of claim 21, wherein said window covering portion is constructed of a fabric material.

26. The window covering assembly of claim 21, wherein said window covering portion is constructed of a plurality of vanes.

* * * * *

UNITED STATES PATENT AND TRADEMARK OFFICE

CERTIFICATE OF CORRECTION

PATENT NO. : 7,556,081 B2
APPLICATION NO. : 11/244721
DATED : July 7, 2009
INVENTOR(S) : Michael Cech and Patrick Reid It is certified that error appears in the above-identified patent and that said Letters Patent is hereby corrected as shown below:

On the Title Pg, Item (57) ABSTRACT, line 6, "allow of for" should read --allow for--.

Column 1, line 33, "which it was specifically" should read --which they were specifically--.

Column 3, line 26, "which is has" should read --which has--.

Column 6, line 55, "simplified, through" should read --simplified through--.

Column 7, line 41, "portion includes" should read --portion 24 includes--.

Column 10, line 8, "mail portion" should read --male portion--.

Signed and Sealed this

Seventeenth Day of August, 2010

David J. Kappos

David J. Kappos
*Director of the United States Patent and Trademark Office*